US011056837B2

(12) United States Patent
Wu et al.

(10) Patent No.: US 11,056,837 B2
(45) Date of Patent: Jul. 6, 2021

(54) ELECTRICAL CONNECTOR EQUIPPED WITH THREE METAL PLATES JOINED TOGETHER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Xiang Wu, Kunshan (CN); Yin-Chao Xu, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 10 days.

(21) Appl. No.: 16/742,869

(22) Filed: Jan. 14, 2020

(65) Prior Publication Data

US 2020/0235528 A1 Jul. 23, 2020

(30) Foreign Application Priority Data

Jan. 21, 2019 (CN) ..... 201920092026.1
Jan. 21, 2019 (CN) ..... 201920092091.4

(51) Int. Cl.
*H01R 13/6582* (2011.01)
*H01R 13/6596* (2011.01)
(Continued)

(52) U.S. Cl.
CPC ..... *H01R 13/6582* (2013.01); *H01R 13/6585* (2013.01); *H01R 13/6596* (2013.01); *H01R 43/20* (2013.01)

(58) Field of Classification Search
CPC ..... H01R 13/6585; H01R 24/60; H01R 13/6582; H01R 13/405; H01R 13/6597; H01R 2107/00; H01R 13/6205; H01R 13/6593; H01R 13/6581; H01R 13/6596; H01R 12/724; H01R 12/775;
(Continued)

(56) References Cited

U.S. PATENT DOCUMENTS 6,843,679 B2 * 1/2005 Kuo ..... H01R 13/6593 439/497
7,914,322 B2 * 3/2011 Lin ..... H01R 12/78 439/497
(Continued)

FOREIGN PATENT DOCUMENTS

CN 104425995 B 1/2017
CN 106684618 B 10/2019

*Primary Examiner* — Edwin A. Leon
*Assistant Examiner* — Matthew T Dzierzynski
(74) *Attorney, Agent, or Firm* — Ming Chieh Chang; Wei Te Chung

(57) ABSTRACT

An electrical connector includes an insulative housing, a plurality of contacts assembled in the housing, opposite metal top and bottom shells attached upon opposite top face and bottom face of the housing, and a metallic shielding plate inserted into the housing and between two rows of contacts. The top shell, the bottom shell and the shielding plate have corresponding ears secured together in an intimately sandwiched manner.

20 Claims, 8 Drawing Sheets

(51) Int. Cl.
*H01R 43/20* (2006.01)
*H01R 13/6585* (2011.01)

(58) Field of Classification Search
CPC ..... H01R 13/504; H01R 13/6586; H01R 13/6591; H01R 43/24; H01R 4/023; H01R 4/027; H01R 12/7005; H01R 13/115; H01R 13/26; H01R 13/40; H01R 13/629; H01R 13/6471; H01R 13/6587; H01R 13/6594; H01R 43/02; H01R 43/20
See application file for complete search history.

(56) References Cited

U.S. PATENT DOCUMENTS

| | | | | |
|---|---|---|---|---|
| 8,808,029 | B2 * | 8/2014 | Castillo | H01R 13/6585 439/607.05 |
| 9,252,531 | B2 * | 2/2016 | Guo | H01R 13/506 |
| 9,385,482 | B2 * | 7/2016 | Li | H01R 13/6585 |
| 9,647,395 | B2 * | 5/2017 | Hsu | H01R 13/6585 |
| 9,653,849 | B2 * | 5/2017 | Hsu | H01R 13/6584 |
| 9,735,512 | B2 * | 8/2017 | Hsu | H01R 13/6596 |
| 10,103,501 | B2 * | 10/2018 | Lin | H01R 12/7005 |
| 10,153,596 | B2 * | 12/2018 | Lin | H01R 12/7005 |

* cited by examiner

ELECTRICAL CONNECTOR EQUIPPED WITH THREE METAL PLATES JOINED TOGETHER

BACKGROUND OF THE DISCLOSURE

1. Field of the Disclosure

The present disclosure relates to an electrical connector, and particularly to the electrical connector equipped with a pair of metallic shells covering the opposite upper and lower surfaces of the housing, and secured to therebetween a metallic shielding plate so as to protectively receive two rows of the corresponding wires in the upper space and the lower space thereamong.

2. Description of Related Arts

U.S. Pat. No. 10,333,255 discloses the receptacle connector for receiving a plug connector wherein top and bottom shells cover the opposite top and bottom surfaces of the housing, and a metallic shielding plate located between two rows of contacts with corresponding spring tangs forwardly extending into the receiving cavity for mechanically and electrically connecting a mating plug connector. Because the shells and the shielding plate therebetween are essentially separated from each other, the mechanical securing effect and the electrical grounding effect are essentially not good enough.

An improved connector assembly is desired to provide an electrical connector with the corresponding contacts having both the preferred mechanical characteristic and electrical characteristic.

SUMMARY OF THE DISCLOSURE

An object of the invention is to provide an electrical connector with an insulative housing, a plurality of contacts assembled in the housing, opposite metal top and bottom shells attached upon opposite top face and bottom face of the housing, and a metallic shielding plate inserted into the housing and between two rows of contacts. The top shell, the bottom shell and the shielding plate have corresponding ears secured together in an intimately sandwiched manner.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
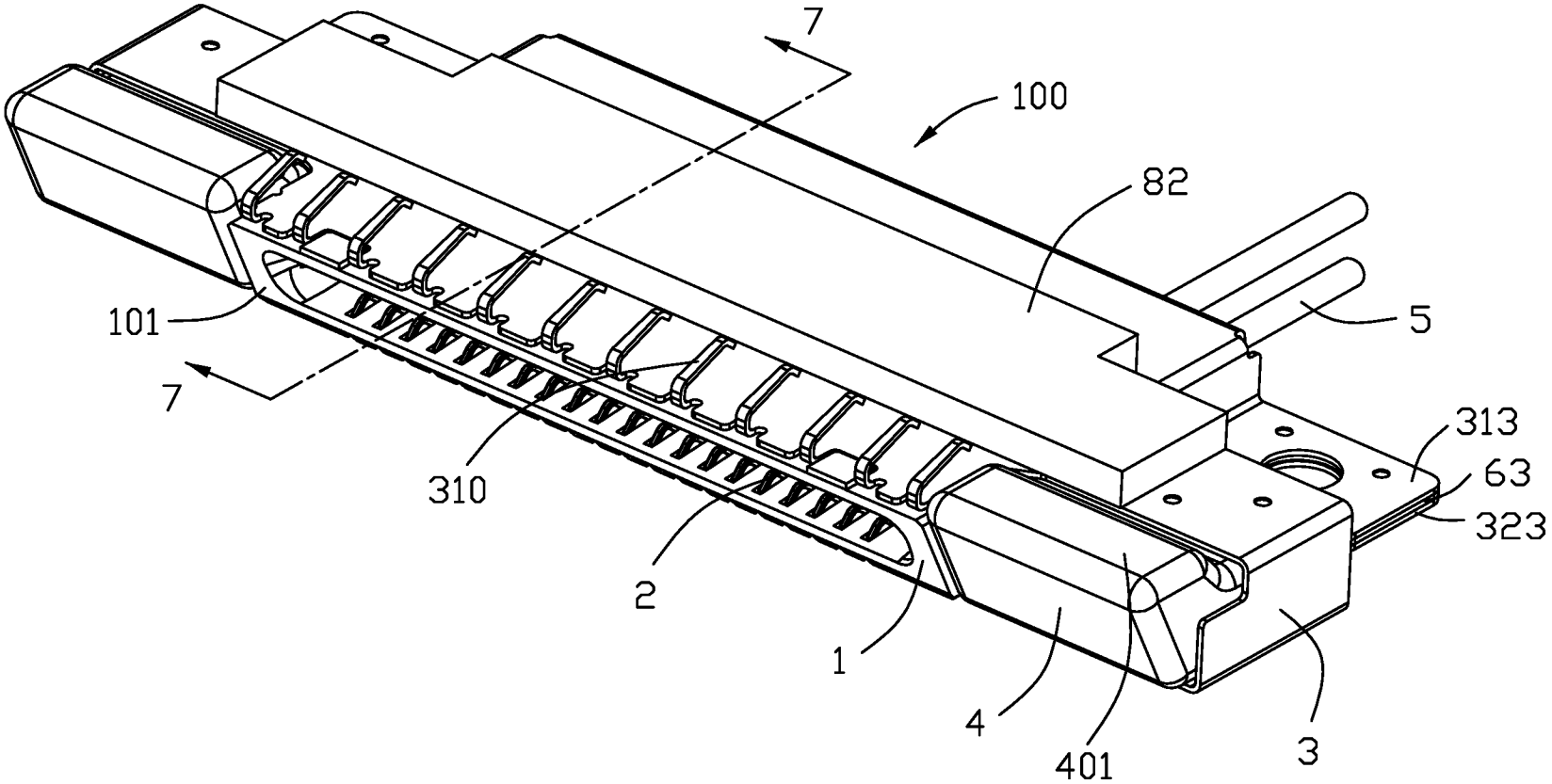
FIG. 1 is a perspective view of an electrical connector of the invention.
Figure 2:
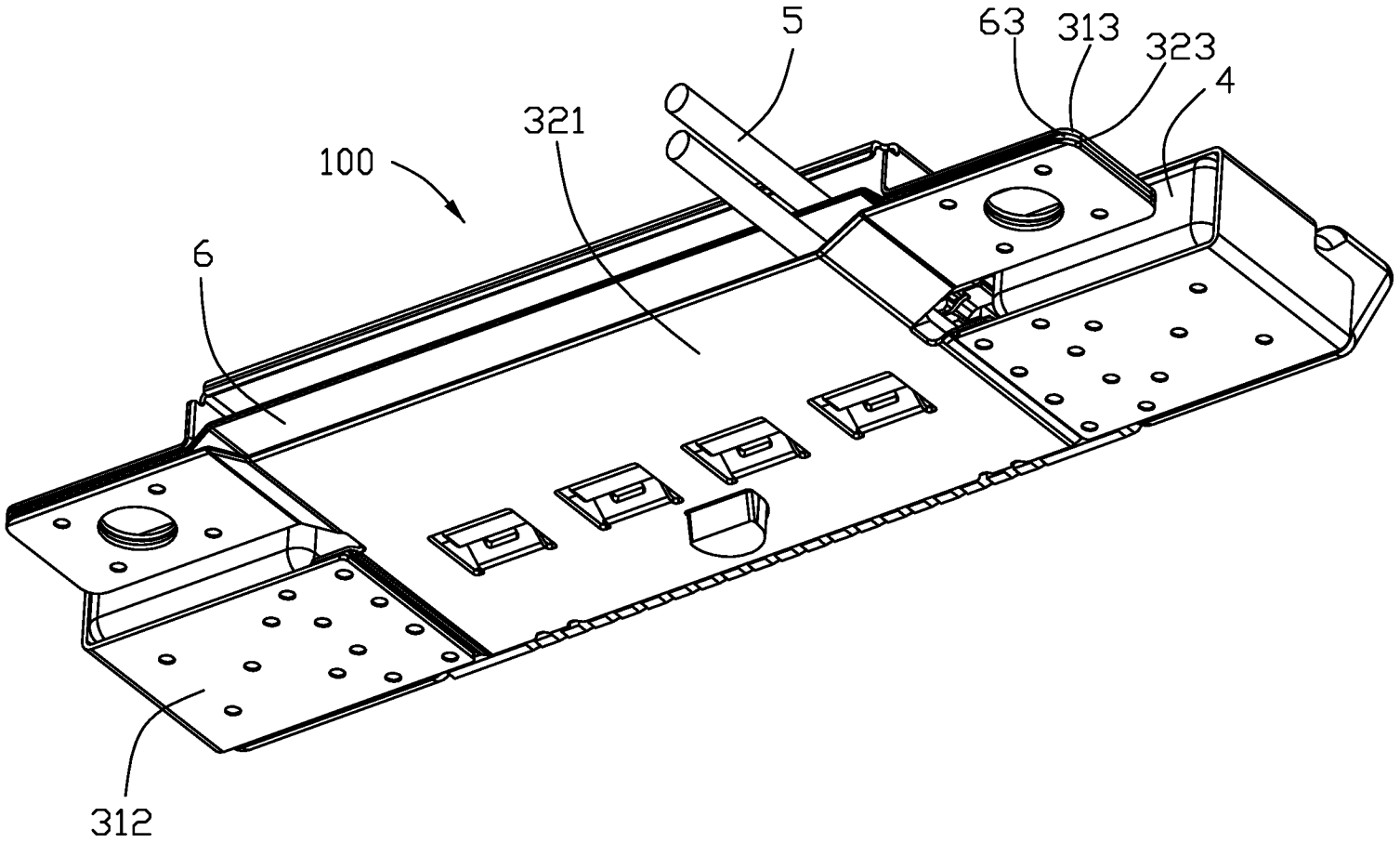
FIG. 2 is another perspective view of the electrical connector of FIG. 1.
Figure 3:
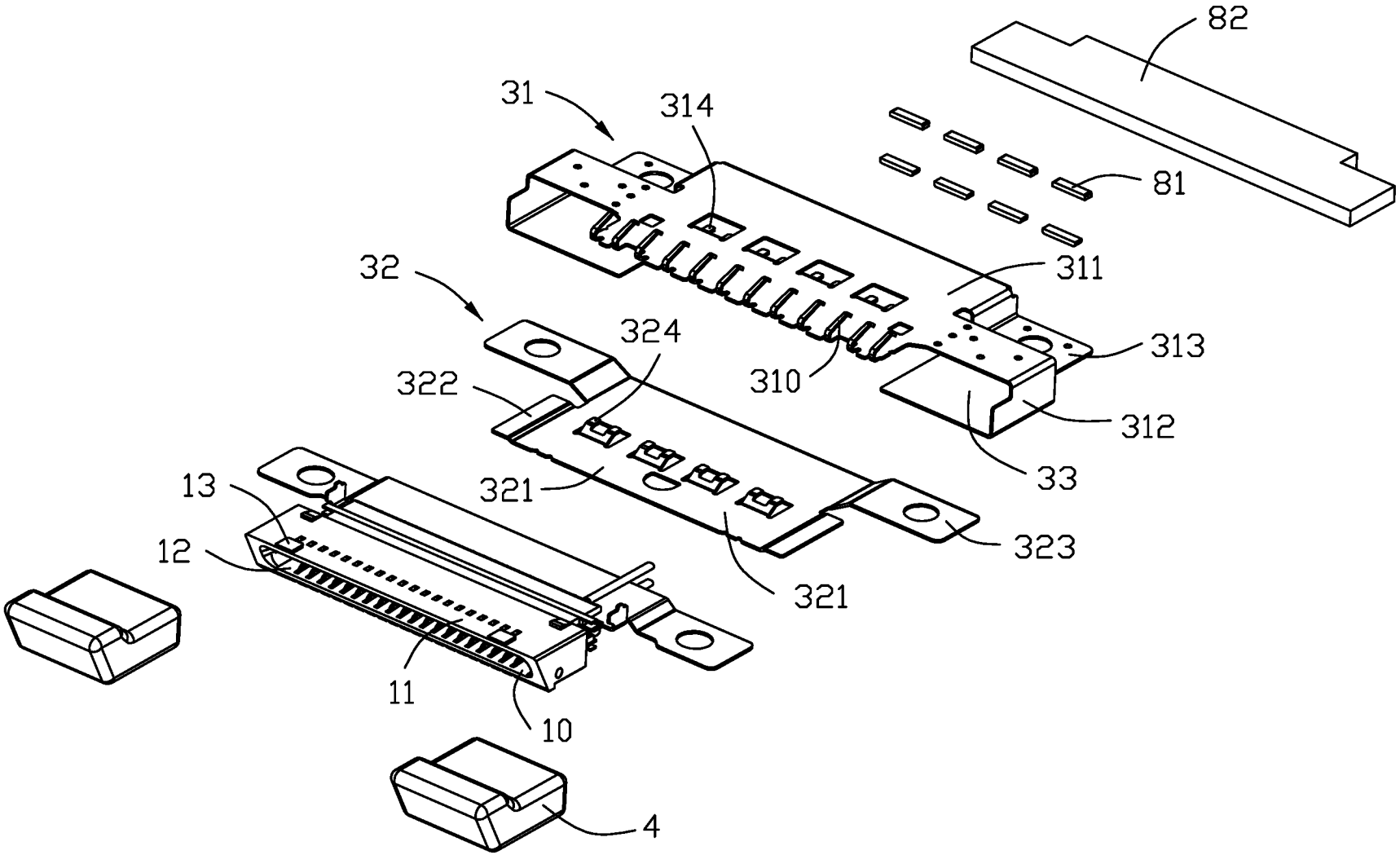
FIG. 3 is an exploded perspective view of the electrical connector of FIG. 1.
Figure 4:
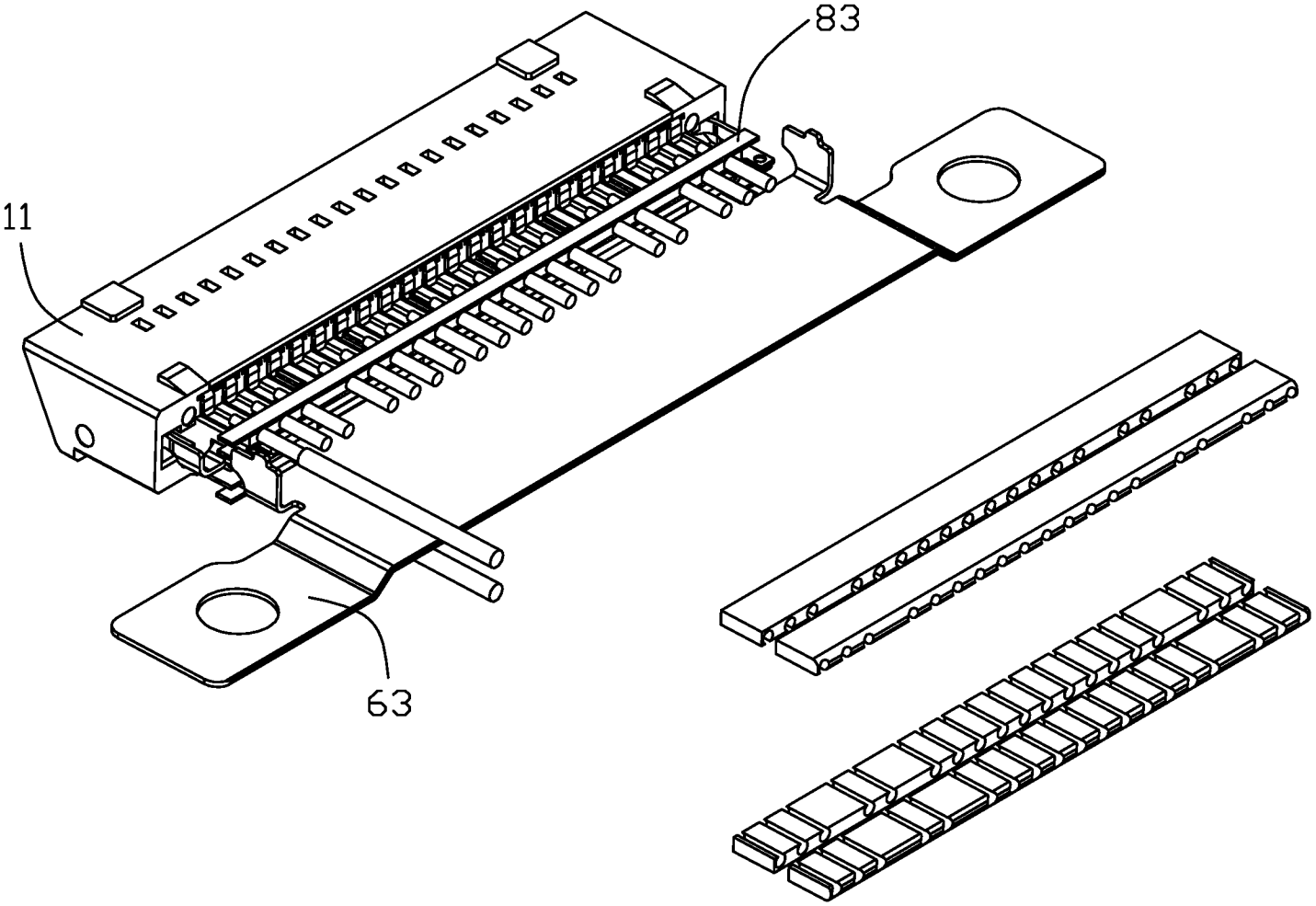
FIG. 4 is an exploded perspective view of a main part of the electrical connector of FIG. 3.
Figure 5:
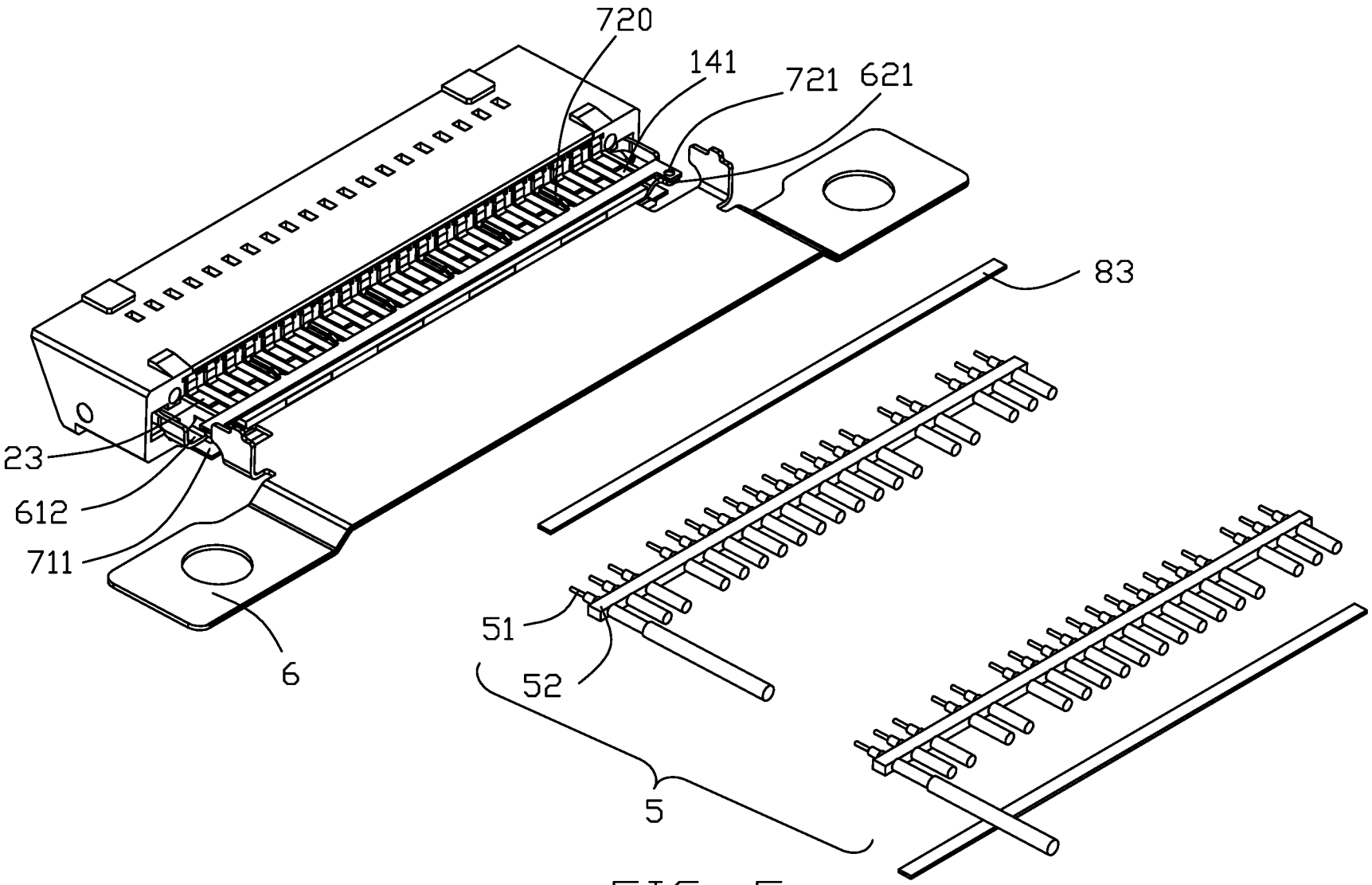
FIG. 5 is a further exploded perspective view of the main part of the electrical connector of FIG. 4.
Figure 6:
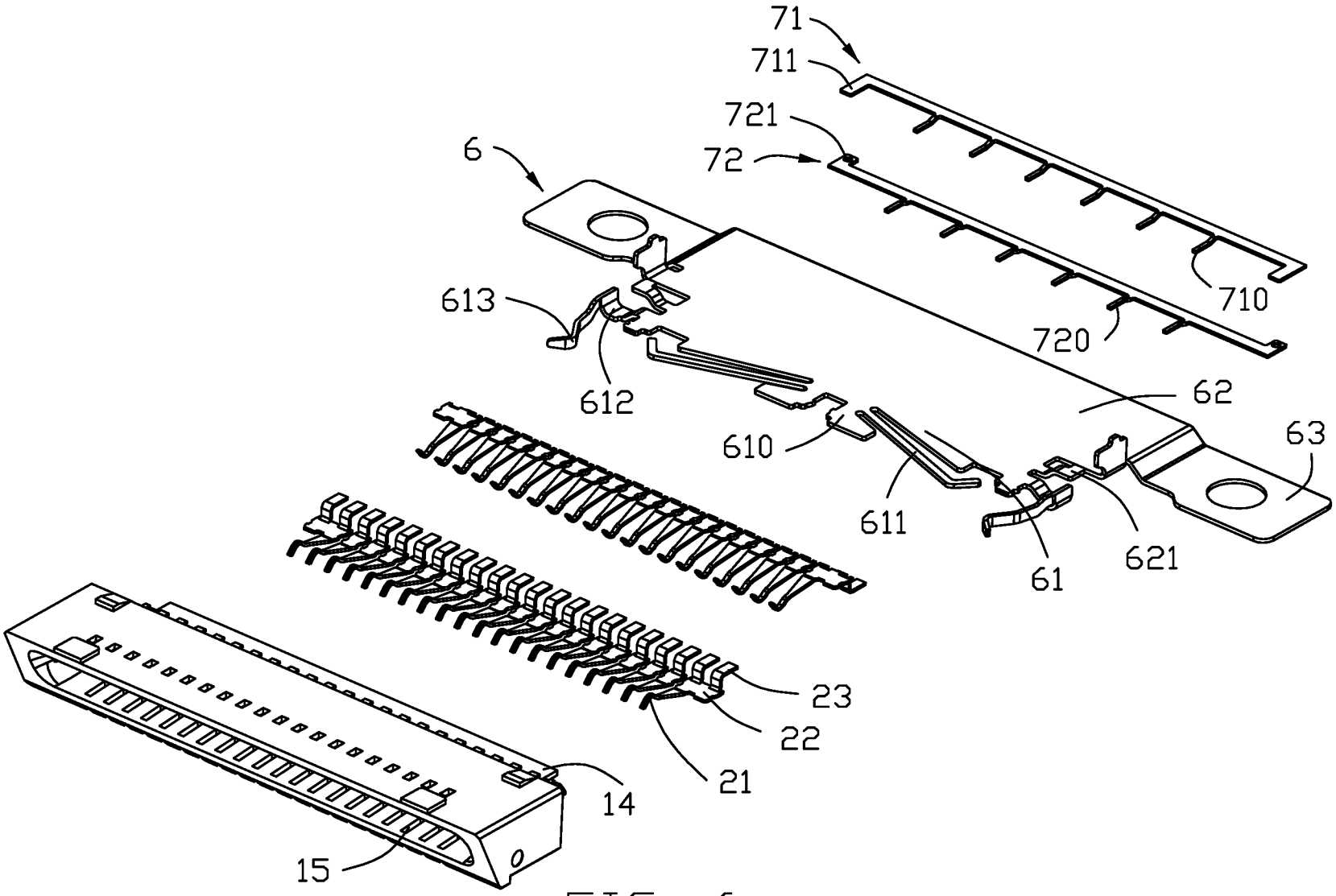
FIG. 6 is further exploded perspective view of the main part of the electrical connector of FIG. 5.
Figure 6A:
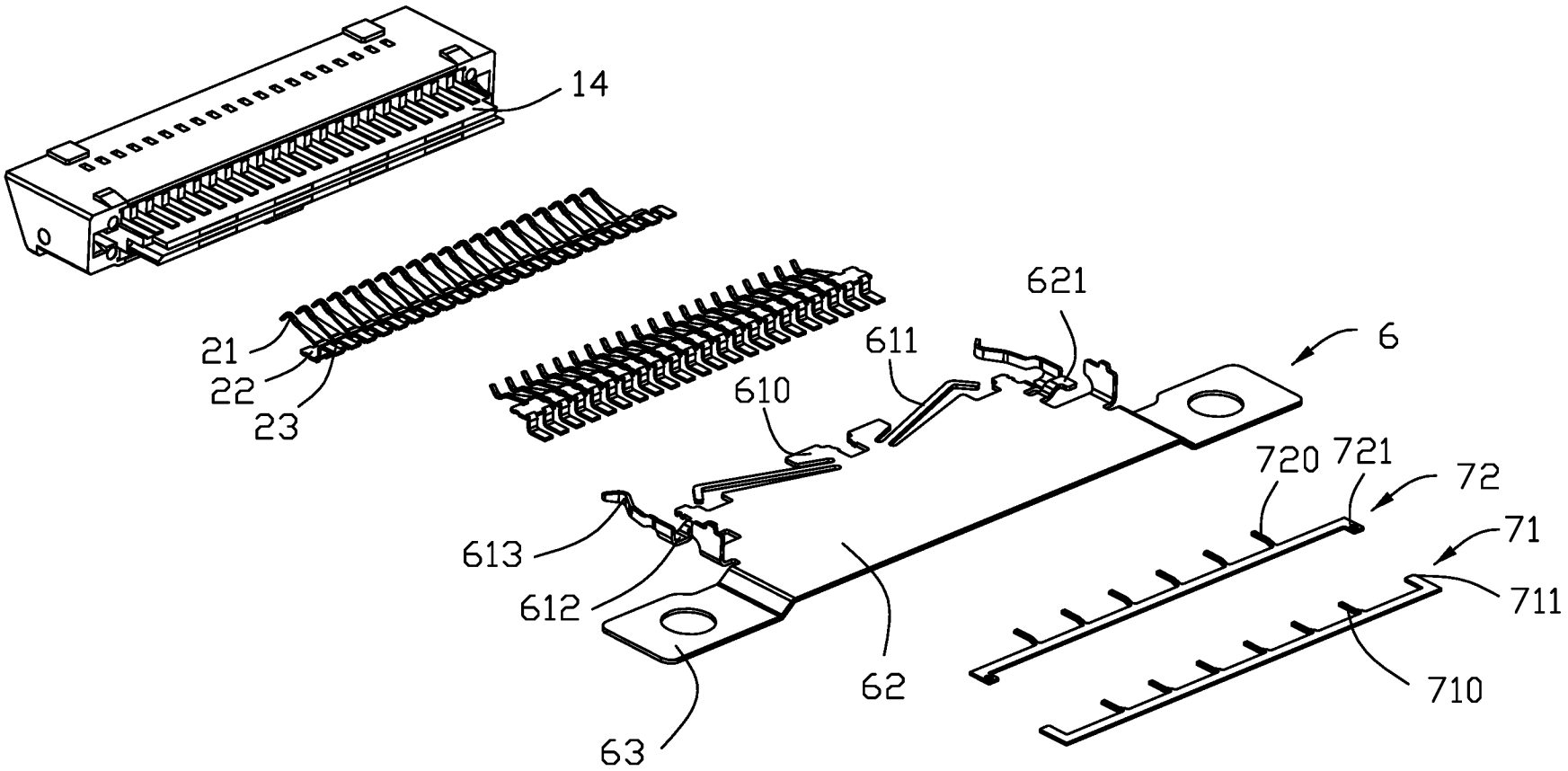
FIG. 6(A) is another exploded perspective view of the main part of the electrical connector of FIG. 3.

Referring to FIGS. 1-7, an electrical connector 100 includes an insulative housing 1, two rows of contacts 2 assembled tot the housing 1, a metallic shell structure 3 enclosing the housing 1, a magnet device 4 enclosed within the shell structure 3, and a plurality of wires 5.

The housing 1 includes a front face 101, a mating cavity 10 forwardly extending through the front face 101 in a front-to-back direction and commonly formed by opposite first/top wall 11, second/bottom wall 12 and two side/end walls 13. The two rows of contacts spaced from each other in the vertical direction, are respectively assembled in the corresponding passageways 15 formed in the corresponding top wall 11 and the bottom wall 12, including the signal contacts, the grounding contacts and the power contacts. A pair of fixing walls 14 are formed on a rear side of the housing 1. Each fixing wall 14 forms a plurality of grooves 141 in alignment with the corresponding passageways, respectively, in the front-to-back direction. The contact 2 includes a contacting section 21 retained in the corresponding passageway 15 and further extending into the mating cavity 10, a soldering/connecting section 23 retained in the corresponding groove 141 and soldered with the corresponding wire 5, and a middle section 22 linked between the contacting section 21 and the soldering section 23.

Figure 7:
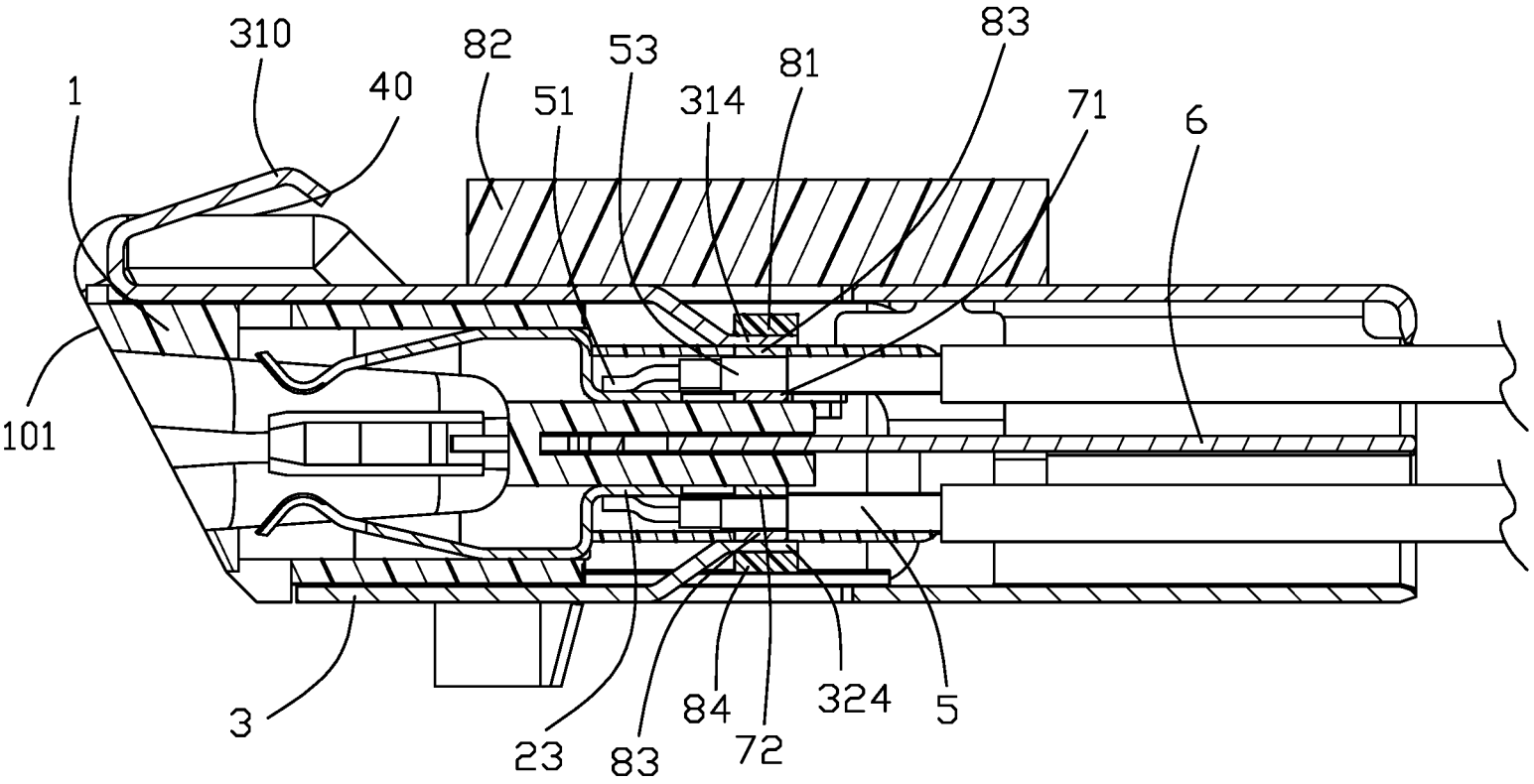
FIG. 7 is a cross-sectional view of the electrical connector of FIG. 1.

The shell structure 3 includes a first/top shell 31 and a second/bottom shell 32. The first shell 31 includes a first plate 311 covering the first wall 11 and forming a plurality of spring tangs 310 for contacting the metallic case (not shown) surrounding the shell structure 3. The first shell 31 further includes a pair of holding sections 312 and a pair of first/top ears 313 at two opposite longitudinal ends, respectively, and a plurality of openings with abutment tabs 314 therein. An insulative block 82 is positioned upon the first shell 31. The second shell 32 includes a second plate 321 with a pair of extensions 322 and a pair of second/bottom ears 323 at two opposite longitudinal ends, respectively, and a plurality of openings with corresponding abutment tabs 324 therein. The solder blocks are attached upon the abutment tabs 314 and 324 for soldering the corresponding outer grounding bar 83 which is mechanically and electrically connected to the exposed braiding layers 53 of the wires 5 (FIG. 7). The holding section 312 forms a space 33 to receive the corresponding magnet device 4 in a welded manner optimally. In this embodiment, the spring tangs 310 extend beyond a top face 401 of the magnet device 4.

A metallic shielding plate 6 is forwardly inserted into the housing 1 and includes an inner/front section 61 sandwiched between the pair of fixing walls 14, and a outer/rear section 62 exposed outside of the fixing walls 14 with a pair of third/middle ears 63 at two opposite longitudinal ends. The pair of third ears 63 are sandwiched between the pair of first ears 313 and the pair of second ears 323 in the vertical direction. Notably, the pair of first ears 313, the pair of second ears 323 and the pair of third ears 63 are secured with each other via welding. The inner section 61 includes the retention tabs 610 and the spring arms 611 extending forwardly into the receiving cavity 10. A pair of first grounding sections 612 extends from two opposite ends of the inner section 61 with corresponding spring latches 613 extending into the receiving cavity 10. The outer section forms a pair of second grounding sections 621 at two opposite longitudinal ends and behind the pair of first grounding contacts 612. A first inner grounding bar 71 a second inner grounding bar 72 are respectively mechanically and electrically connected to the braiding layers 53 of the two rows of wires 5. The first inner grounding bar 71 includes a pair of first grounding legs 711 at two opposite longitudinal ends to mechanically and electrically connect the pair of corresponding first grounding sections 612, and the second inner grounding bar 72 includes a pair of second grounding legs 721 at two opposite longitudinal ends to mechanically and electrically connect the pair of corresponding second grounding sections 621. Each of the first inner grounding bar 71 and the second inner grounding bar 72 includes a plurality of spring legs 710, 720 to electrically and mechanically connect the corresponding grounding contacts of the two rows of contacts 2

The wires 5 are mechanically and electrical connected to the corresponding contacts 2 via the inner conductors 51 of the wires 5 and the soldering sections 23 of the contacts 2. The wires 5 are integrally retained by an insulative bar 52. As shown in FIG. 7, the inner grounding bars 71 and 72 are located at the inner side of the braiding layer 53 while the outer grounding bars 83 are located at the outer side of the braiding layer 53.

In brief, the shells 31, 32 and the shielding plate 6 are mechanically and electrically connected and secured together via the corresponding ears 313, 63 and 323, thus assuring the mechanical strength and the electrical performance thereof. Notably, the ears 313, 63 and 323 respectively form the corresponding through holes therein so as to allow the screw to extend therethrough in the vertical direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising: an insulative housing defining a mating cavity forwardly communicating with an exterior in a front-to-back direction; two rows of contacts retained in the housing, each of the contacts including a front contacting section extending into the mating cavity, and a rear connecting section exposed on a rear side of the housing; a metallic shielding plate assembled to the housing and located between the two rows of the contacts in a vertical direction perpendicular to the front-to-back direction; and opposite metallic top shell and bottom shell discrete from each other and attached upon opposite top wall and bottom wall of the housing; wherein the top shell, the bottom shell and the shielding plate are secured to one another around the rear side of the housing in an intimate manner with the shielding plate intimately sandwiched between the top shell and the bottom shell.

2. The electrical connector as claimed in claim 1, wherein the top wall forms a pair of top ears at two opposite longitudinal ends thereof in a longitudinal direction perpendicular to both the front-to-back direction and the vertical direction, the bottom shell forms a pair of bottom ears at two opposite longitudinal ends thereof, and the shielding plate forms a pair of middle ears located at opposite longitudinal ends thereof and intimately sandwiched between and aligned with the pair of top ears and the pair of bottom ears in the vertical direction, respectively.

3. The electrical connector as claimed in claim 2, wherein each of the top ear, the bottom ear and the middle ear forms a through hole so as to form a common hole in the vertical direction.

4. The electrical connector as claim 1, wherein two rows of wires are connected to the connecting sections of the corresponding two rows of contacts around the rear side of the housing and extend in corresponding spaces formed between the top shell and the shielding plate, and between the bottom shell and the shielding plate.

5. The electrical connector as claimed in claim 4, wherein each of the wires includes a conductive braiding layer, an outer grounding bar mechanically and electrically connect the braiding layers of the contacts in a same row, and each of the top shell and the bottom shell forms a plurality of abutment tabs mechanically and electrically connected to the corresponding outer grounding bar.

6. The electrical connector as claimed in claim 5, wherein the abutment tabs are securely fixed to the corresponding outer grounding bar.

7. The electrical connector as claimed in claim 4, wherein each of the wires includes a conductive braiding layer, an inner grounding bar mechanically and electrically connect the braiding layers of the contacts in a same row, and the shielding plate mechanically and electrically connects to the inner grounding bar.

8. The electrical connector as claimed in claim 7, wherein the shielding plate is securely fixed to the inner grounding bar.

9. The electrical connector as claimed in claim 1, wherein the shielding plate unitarily forms a pair of spring latches forwardly extending into the mating cavity around two opposite longitudinal ends in the longitudinal direction.

10. An electrical connector comprising: an insulative housing defining a mating cavity forwardly communicating with an exterior in a front-to-back direction; two rows of contacts retained in the housing, each of the contacts including a front contacting section extending into the mating cavity, and a rear connecting section exposed on a rear side of the housing; a metallic shielding plate assembled to the housing and located between the two rows of the contacts in a vertical direction perpendicular to the front-to-back direction; and opposite metallic top shell and bottom shell discrete from each other and attached upon opposite top wall and bottom wall of the housing; two rows of wires extending rearward around the rear side of the housing, each of the wires including an inner conductor soldered to the connecting section of the corresponding contact, a metallic braiding surrounding the inner conductor; a metallic grounding bar extending along the longitudinal direction and mechanically and electrically connected to the braiding layers of the wires in a same row; and one of the top shell and the bottom shell forms a plurality of abutment tabs to mechanically and electrically connect to the grounding bar.

11. The electrical connector as claimed in claim 10, wherein a plurality of spring tangs backwardly extend from a front edge of the top shell in a folded manner.

12. The electrical connector as claimed in claim 10, wherein one of the top shell and the bottom shell forms a pair of ears at two opposite longitudinal ends in the longitudinal direction to mechanically and electrically connected to the shielding plate.

13. The electrical connector as claimed in claim 12, wherein the pair of ears are securely fixed to a pair of ears of the shielding plate.

14. The electrical connector as claimed in claim 13, wherein both two pairs of ears form corresponding through holes therein.

15. The electrical connector as claimed in claim 10, further including an inner grounding bar mechanically and electrically connected to the braiding layer of the wires in the same row, wherein the shielding plate is mechanically and electrically connected to the inner grounding bar.

16. An electrical connector comprising: an insulative housing defining a mating cavity forwardly communicating with an exterior in a front-to-back direction; two rows of contacts retained in the housing, each of the contacts including a front contacting section extending into the mating cavity, and a rear connecting section exposed on a rear side of the housing; a metallic shielding plate assembled to the housing and located between the two rows of the contacts in a vertical direction perpendicular to the front-to-back direction; and opposite metallic top shell and bottom shell discrete from each other and attached upon opposite top wall and bottom wall of the housing; wherein the top shell includes a plate covering the top wall of the housing, a pair of holding sections to receive a pair of magnets therein at two opposite longitudinal ends thereof, and a pair of top flat ears located at the two opposite longitudinal ends and behind the pair of holding sections in the front-to-back direction to be securely fixed to the shielding plate.

17. The electrical connector as claimed in claim 16, wherein each of said top flat ears forms a through hole in the vertical direction.

18. The electrical connector as claimed in claim 17, wherein the shielding plate forms a pair of middle flat ears aligned with intimately below the top flat ears, respectively.

19. The electrical connector as claimed in claim 18, wherein the bottom shell is securely fixed to the middle flat ears.

20. The electrical connector as claimed in claim 19, wherein the bottom shell includes a pair of bottom flat ears securely fixed to the middle flat ears, respectively.

* * * * *